US010442580B2

(12) United States Patent
Murrill

(10) Patent No.: US 10,442,580 B2
(45) Date of Patent: Oct. 15, 2019

(54) CHEMICAL STORAGE CONTAINER WITH LOCKING HINGE

(71) Applicant: Steven Murrill, Theodore, AL (US)

(72) Inventor: Steven Murrill, Theodore, AL (US)

( * ) Notice: Subject to any disclaimer, the term of this patent is extended or adjusted under 35 U.S.C. 154(b) by 48 days.

(21) Appl. No.: 15/703,982

(22) Filed: Sep. 13, 2017

(65) Prior Publication Data

US 2018/0127162 A1 May 10, 2018

Related U.S. Application Data

(63) Continuation-in-part of application No. 15/703,978, filed on Sep. 13, 2017.

(60) Provisional application No. 62/420,430, filed on Nov. 10, 2016.

(51) Int. Cl.

| | |
|---|---|
| ***B65D 43/16*** | (2006.01) |
| ***B65D 43/02*** | (2006.01) |
| ***B65D 1/16*** | (2006.01) |
| ***E05D 3/06*** | (2006.01) |
| ***E05D 7/10*** | (2006.01) |
| *E05D 3/02* | (2006.01) |
| *E05D 7/00* | (2006.01) |

(52) U.S. Cl.

CPC ..... *B65D 43/165* (2013.01); *B65D 1/16* (2013.01); *B65D 43/0204* (2013.01); *B65D 43/162* (2013.01); *E05D 3/06* (2013.01); *E05D 7/1044* (2013.01); *E05D 7/009* (2013.01); *E05D 2003/025* (2013.01); *E05Y 2900/602* (2013.01)

(58) Field of Classification Search

CPC .. B65D 43/165; B65D 43/164; B65D 43/163; B65D 43/16; B65D 43/162; B65D 43/169; B65D 43/0204; B65D 43/0202; B65D 43/02; B65D 25/32; B65D 25/28; B65D 25/2802; E05D 3/06; E05D 7/1044; E05D 7/1055; E05D 7/105; E05D 7/009

USPC ..... 220/836, 840, 843, 844, 810, 324, 315, 220/760, 759, 769, 770, 756

See application file for complete search history.

(56) References Cited

U.S. PATENT DOCUMENTS 1,784,588 A * 12/1930 Green ..... A47L 13/51 15/104.001
2,593,971 A * 4/1952 Brandt ..... B65D 45/24 220/324
2,624,907 A * 1/1953 Graham ..... E05D 1/06 16/224
2,637,460 A 5/1953 Yates (Continued)

FOREIGN PATENT DOCUMENTS

EP 0146651 A1 * 7/1985 ..... B62D 33/033

OTHER PUBLICATIONS

Translation of EP146651A, Nieland, Jul. 3, 1985, Fig. 1 (Year: 1985).*

(Continued)

*Primary Examiner* — Robert J Hicks

(74) *Attorney, Agent, or Firm* — AdamsIP, LLC; J. Hunter Adams; Stephen Thompson

(57) ABSTRACT

A storage container is provided. The container includes a receptacle and a lid connected to the receptacle by a hinge. The lid has a latch for sealing the receptacle closed. The receptacle and the lid are each made from a continuous unitary piece of material that has hinge components formed within the material.

16 Claims, 13 Drawing Sheets

(56) References Cited

U.S. PATENT DOCUMENTS 2,963,734 A * 12/1960 Huget ..... E05D 7/105 16/266
3,185,338 A * 5/1965 Henning ..... A45C 13/28 220/318
3,188,686 A * 6/1965 Orcutt ..... E05D 5/128 16/263
3,212,125 A * 10/1965 Hussell ..... A45C 13/005 16/257
3,295,713 A 1/1967 Optner
4,615,464 A * 10/1986 Byrns ..... B29C 49/0031 16/341
4,987,639 A * 1/1991 Baiuley ..... B65D 25/2858 16/222
5,127,132 A * 7/1992 Karlin ..... E05D 7/1044 16/261
5,311,643 A 5/1994 Marquardt
5,666,695 A 9/1997 Jegers
6,000,576 A * 12/1999 Liu ..... B65D 21/064 206/508
6,131,320 A 10/2000 Eberle
6,315,154 B1 * 11/2001 Newby, Sr. ..... B65D 43/165 16/380
6,701,573 B1 3/2004 Ciavarella
7,370,891 B1 * 5/2008 Schmitt ..... E05B 17/2053 292/113
8,066,143 B2 * 11/2011 Baltz ..... B65D 1/22 220/324
8,584,319 B1 11/2013 Ludin
8,584,322 B2 11/2013 Nakasone
2005/0066476 A1 3/2005 Van Parys
2005/0103797 A1 * 5/2005 Rader ..... B65D 43/165 220/844
2006/0277720 A1 12/2006 Hoffman
2007/0050943 A1 3/2007 Chiu
2007/0289096 A1 12/2007 Zhang
2009/0272501 A1 11/2009 Lee
2011/0072619 A1 3/2011 Wang
2011/0127264 A1 * 6/2011 Whalen ..... A45C 5/03 220/203.01
2016/0319995 A1 * 11/2016 Hobbs ..... F17C 13/06
2018/0216380 A1 8/2018 Butler

OTHER PUBLICATIONS

Non-final Office Action dated Apr. 17, 2019 in U.S. Appl. No. 15/703,978, filed Sep. 13, 2017, Murrill.

* cited by examiner

CHEMICAL STORAGE CONTAINER WITH LOCKING HINGE

CROSS REFERENCES

This application claims the benefit of U.S. Provisional Application No. 62/420,430 filed on Nov. 10, 2016, and U.S. Nonprovisional application Ser. No. 15/703,978, filed Sep. 13, 2017, which applications are incorporated herein by reference.

FIELD OF THE INVENTION

A preferred implementation of the present invention refers generally to a container for securely storing materials therein.

BACKGROUND

In the chemical industry, workers must frequently interact with, utilize, and transport hazardous chemical compositions. These chemical compositions are typically stored within various types of storage containers. To access and utilize a desired chemical composition, a worker must first open the storage container, remove a desired amount of chemical, and subsequently reseal the storage container. However, storage containers currently used within the field are often extremely difficult to open and securely reseal after use. As such, chemical storage containers currently used, such as five-gallon pails, often require the use of various opening tools, such as a pail lid opener, and sealing tools, such as a mallet.

Because these containers require a great deal of effort to ensure the container is securely sealed after use, workers in the field often simply place the lid of the container on top of the container's opening after use without securely fastening the lid in place, thus permitting the chemical compositions stored within to potentially escape if the container is knocked over, tilted, lifted, or transported. Further, if the storage container is not securely sealed, the chemical composition may disperse into the atmosphere and cause environmental harm. Thus, because chemical storage containers currently used in the field are overly difficult to reseal, they, in effect, promote workers to inadequately reseal such containers and thus negatively impact the environment and contribute to an unsafe work environment. Additionally, because failing to securely reseal such containers is a violation of industry regulations, the use of such containers also frequently contributes to chemical facilities incurring fines and safety citations.

Accordingly, there is a need for a storage container that can be easily opened and securely resealed without the use of various tools as a means to ensure safe working conditions, prevent environmental degradation, and reduce fines and safety citations incurred by a chemical facility.

SUMMARY

In one aspect, a storage container comprising a receptacle and a lid connected to the receptacle by a hinge, wherein the lid has a latch for sealing the receptacle closed, is provided. In a preferred embodiment, the receptacle may be a five-gallon pail or bucket that has a circular bottom and a continuous circular sidewall and that is suitable for storing chemical compositions, which may include hazardous chemicals. The lid preferably has a seal installed thereon to form a seal with the receptacle when the lid is closed in order to prevent leakage of chemicals stored therein.

In a preferred embodiment, the hinge connecting the lid to the receptacle is designed so that the lid cannot be easily disconnected from the receptacle by disassembling the hinge. This feature may be advantageous in some applications, such as in certain industrial applications, in which storage containers may be required to remain closed at all times except when the contents of the container must be accessed. In another preferred embodiment, the components of the hinge are all integrally attached to the receptacle and to the lid without any additional separate hinge components. This feature may be advantageous due to the hinge having fewer components than currently available hinges, which may provide for ease of installation of the lid on the receptacle as well as a reduction in manufacturing costs.

The hinge preferably comprises one or more mating pins and corresponding knuckles that lock in an axially fixed position relative to each other when mated together. Each pin is integrally attached to the lid, and each knuckle is integrally attached to the receptacle. To connect the lid to the receptacle, each pin is inserted into a corresponding knuckle. Each pin is configured for one-way insertion such that the pin cannot be removed by withdrawing the pin. Thus, once the corresponding pins and knuckles are locked in place, the lid may not be easily removed from the receptacle by disassembling the hinge. When mated together, each pin and knuckle may freely rotate back and forth relative to each other within a defined angle of rotation such that the lid may be moved between an open position and a closed position. Each pin is attached to a first leaf, which is attached to the lid, and each knuckle is attached to a second leaf, which is attached to the receptacle. Thus, a separate pin is not utilized.

In a preferred embodiment, the hinge comprises a plurality of axially aligned pins attached to the first leaf and a plurality of spaced knuckles attached to the second leaf, wherein each knuckle corresponds to a respective pin. Each pin has a body and a head having a diameter greater than a diameter of the body, and each knuckle defines a passageway axially aligned with and sized to receive the head of one of the pins therein. In addition, each knuckle has an edge sized and positioned to contact a bottom surface of the head of one of the pins after insertion of the pin into the knuckle. Once the pin is inserted, the edge prevents axial movement of the pin in a direction opposite a direction of insertion.

The passageway of each knuckle is preferably an open passageway, and each knuckle preferably has a grooved notch extending along a length of the knuckle in an axial direction. The notch allows the knuckle to flex outwardly in a radial direction to an extent sufficient to allow the head of the pin to pass through the knuckle due to a slight expansion in the size of the passageway. Thus, each knuckle and the head of each corresponding pin are sized such that an exterior surface of the head contacts an interior surface of the knuckle when the pin is inserted into the knuckle. Force is applied to the pin to insert the head of the pin through the knuckle and past the edge of the knuckle. As the head of the pin passes through the knuckle, the passageway within the knuckle expands slightly to allow passage. Once the head of the pin is inserted past the edge of the knuckle, the knuckle returns to its original shape before flexing such that the edge of the knuckle prevents removal of the pin by withdrawing the pin. The pin is then axially locked in a fixed position, and the pin and knuckle may freely rotate back and forth relative to each other within a defined angle of rotation.

In a preferred embodiment, the lid, the first leaf, the plurality of axially aligned pins, and the latch are formed from a unitary piece of material, and the receptacle, the second leaf, and the plurality of spaced knuckles are additionally formed from a second, separate unitary piece of material. Preferably, the separate pieces are each injection molded. Utilizing injection molded, unitary pieces of material to separately form both the receptacle and the lid allows the container to be constructed from only two separate parts, which provides simple connection of the lid to the receptacle and additionally may provide a reduction of manufacturing costs.

The foregoing summary has outlined some features of the device of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the device disclosed herein. Those skilled in the pertinent art should also realize that such equivalent designs or modifications do not depart from the scope of the systems and methods of the present disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
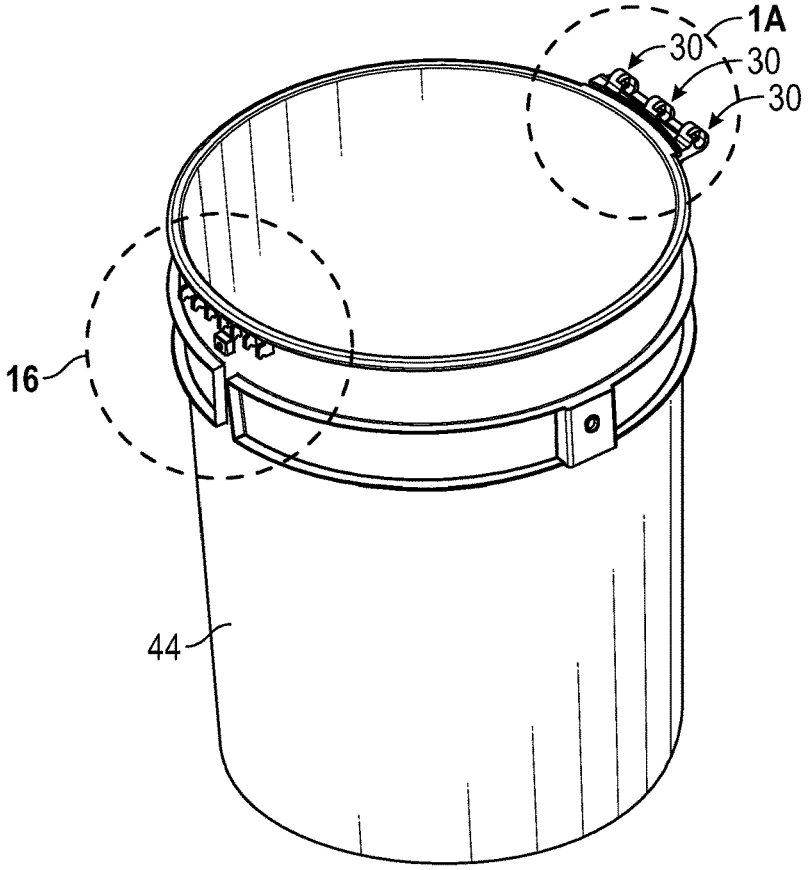
FIG. 1 shows a perspective view of a receptacle comprising a hinge leaf and spaced hinge knuckles attached thereto in accordance with the present disclosure.

In one aspect, a storage container comprising a receptacle 44 and a lid 46 connected to the receptacle 44 by a hinge, wherein the lid 46 has a latch 60 for sealing the receptacle 44 closed, is provided. In a preferred embodiment, as shown in FIG. 1, the receptacle 44 may be a five-gallon pail or bucket that has a circular bottom and a continuous circular sidewall and that is suitable for storing chemical compositions, which may include hazardous chemicals. The lid 46 preferably has a seal 80 installed thereon to form a seal with the receptacle 44 when the lid 46 is closed in order to prevent leakage of chemicals stored therein.

Figure 1A:
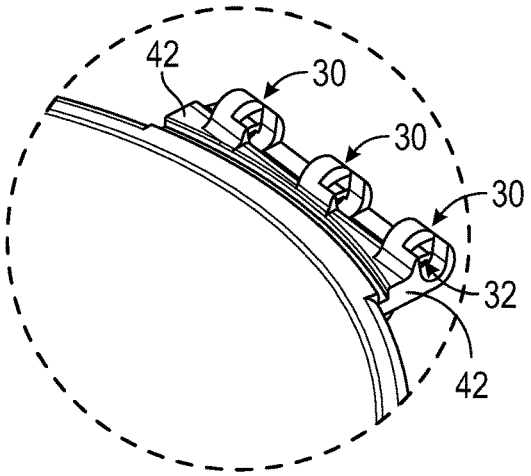
FIG. 1A shows a partial perspective view of a receptacle comprising a hinge leaf and spaced hinge knuckles attached thereto in accordance with the present disclosure.
Figure 2:
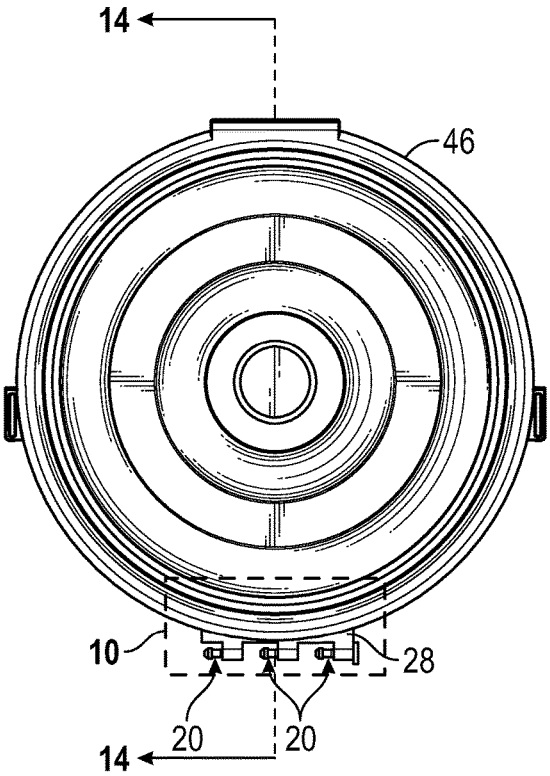
FIG. 2 shows a top plan view of a lid comprising a hinge leaf and hinge pins attached thereto in accordance with the present disclosure.
Figure 3:
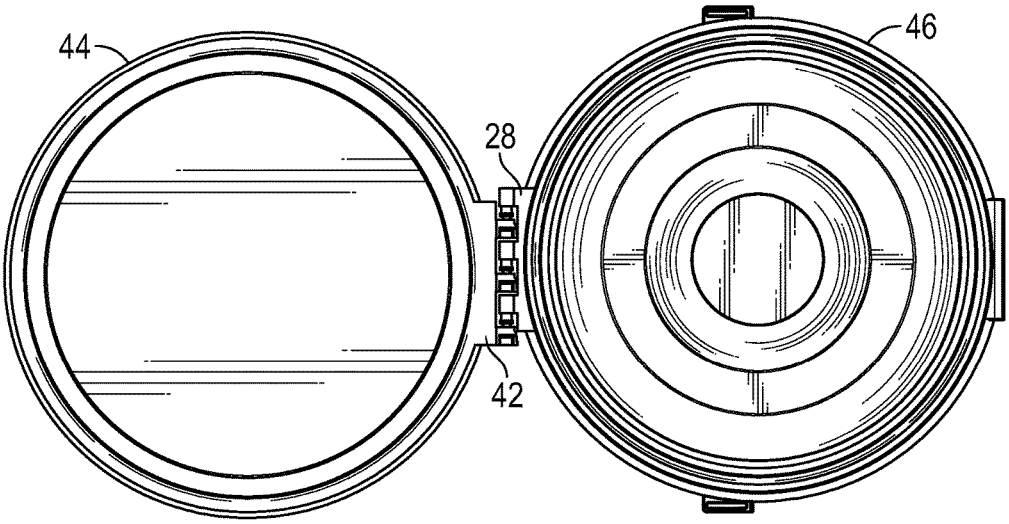
FIG. 3 shows a top plan view of a receptacle and lid before connecting the lid to the receptacle via a hinge in accordance with the present disclosure.
Figure 4:
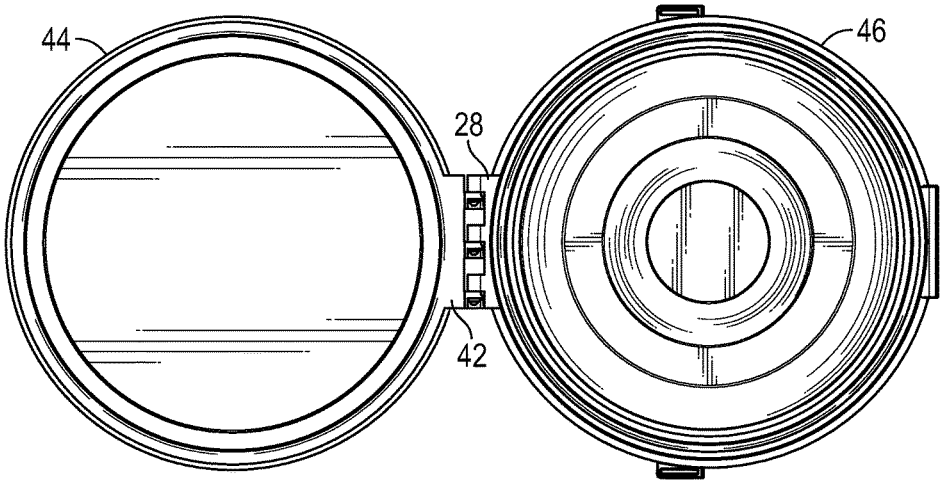
FIG. 4 shows a top plan view of a receptacle and lid after connecting the lid to the receptacle via a hinge with the lid open in accordance with the present disclosure.
Figure 5:
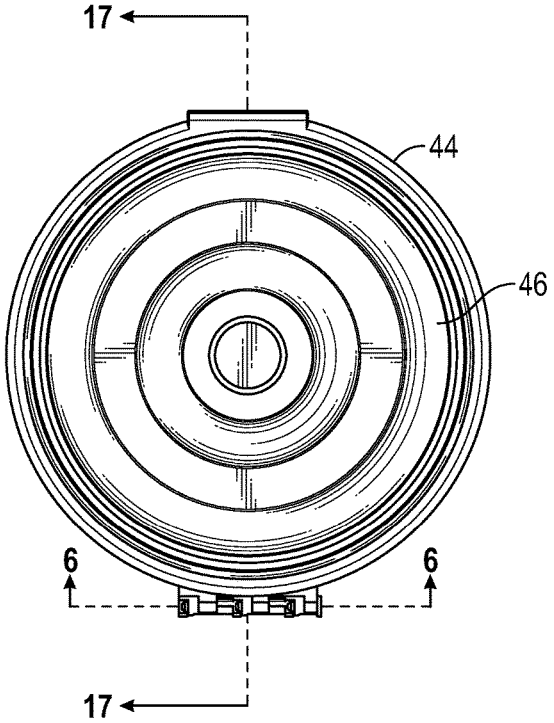
FIG. 5 shows a top plan view of a receptacle and lid after connecting the lid to the receptacle via a hinge with the lid closed in accordance with the present disclosure.
Figure 6:
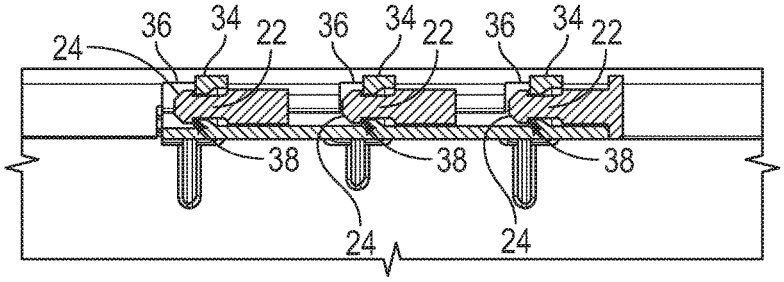
FIG. 6 shows a cross-sectional view of a hinge connecting a lid to a receptacle as seen along line 6-6 in FIG. 5.
Figure 7:
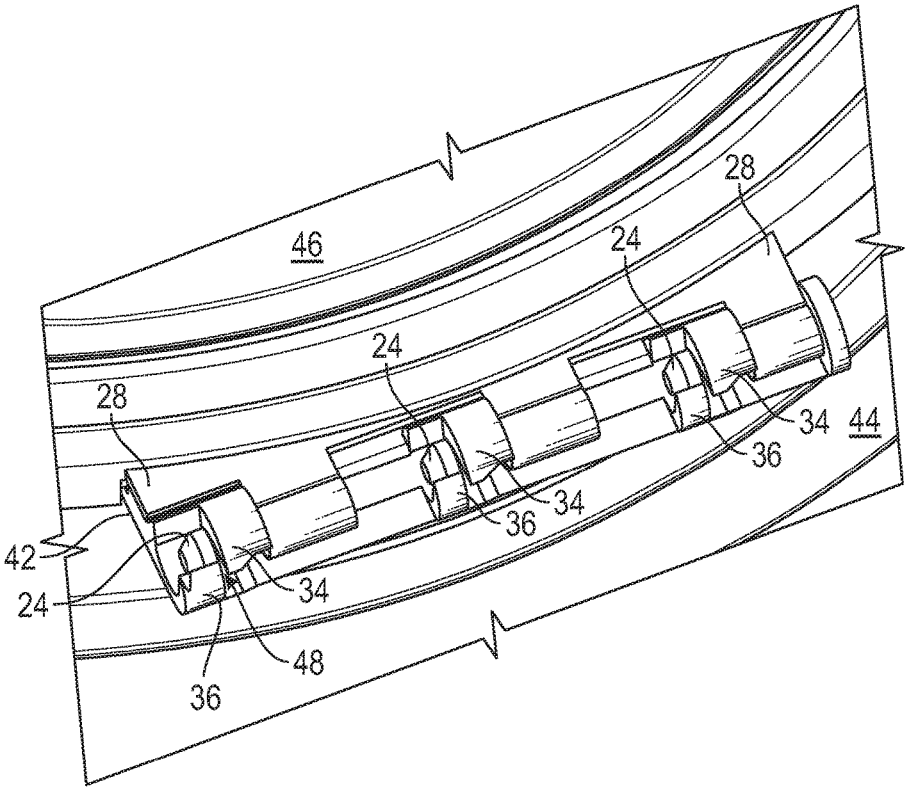
FIG. 7 shows a partial perspective view of a receptacle and lid after connecting the lid to the receptacle via a hinge with the lid closed in accordance with the present disclosure.
Figure 8:
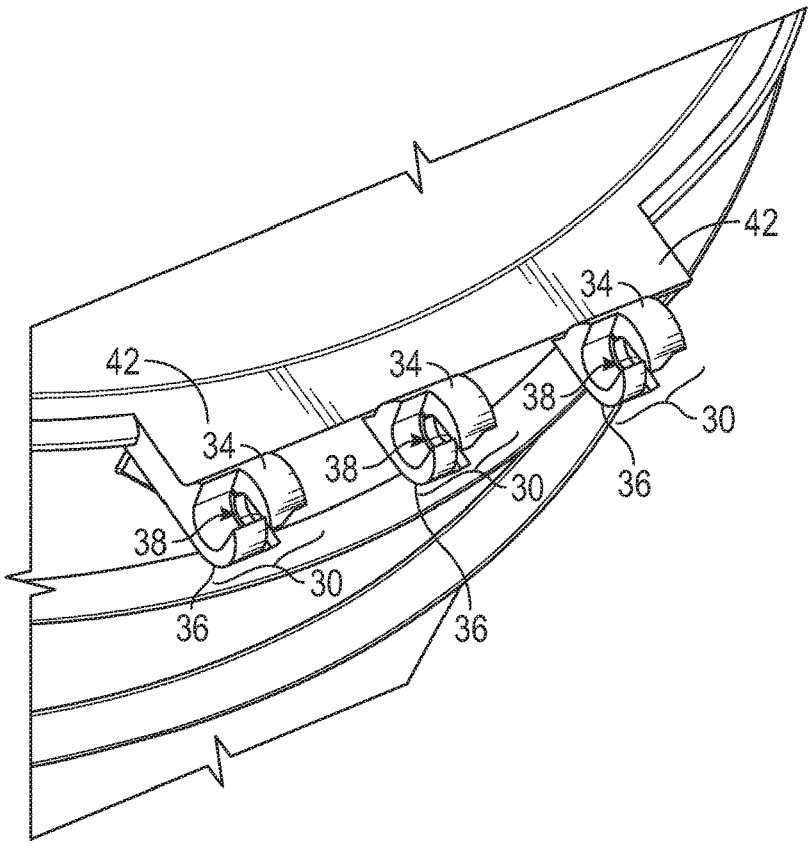
FIG. 8 shows a partial perspective view of a receptacle comprising a hinge leaf and spaced hinge knuckles attached thereto in accordance with the present disclosure.
Figure 9:
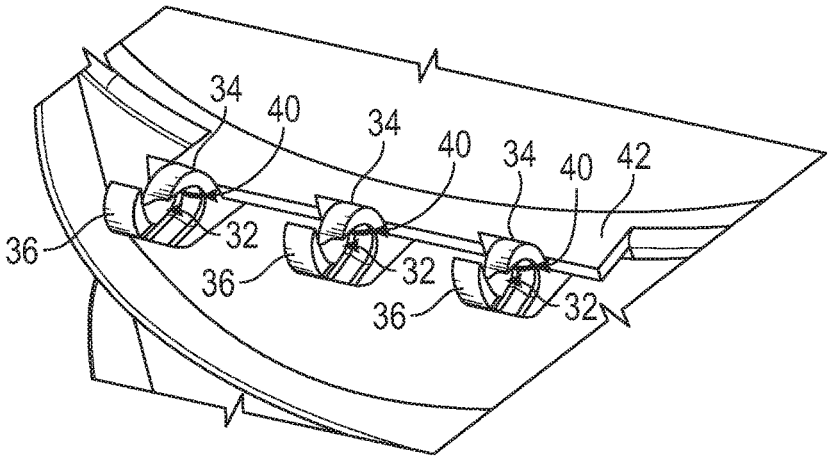
FIG. 9 shows a partial perspective view of a receptacle comprising a hinge leaf and spaced hinge knuckles attached thereto in accordance with the present disclosure.
Figure 10:
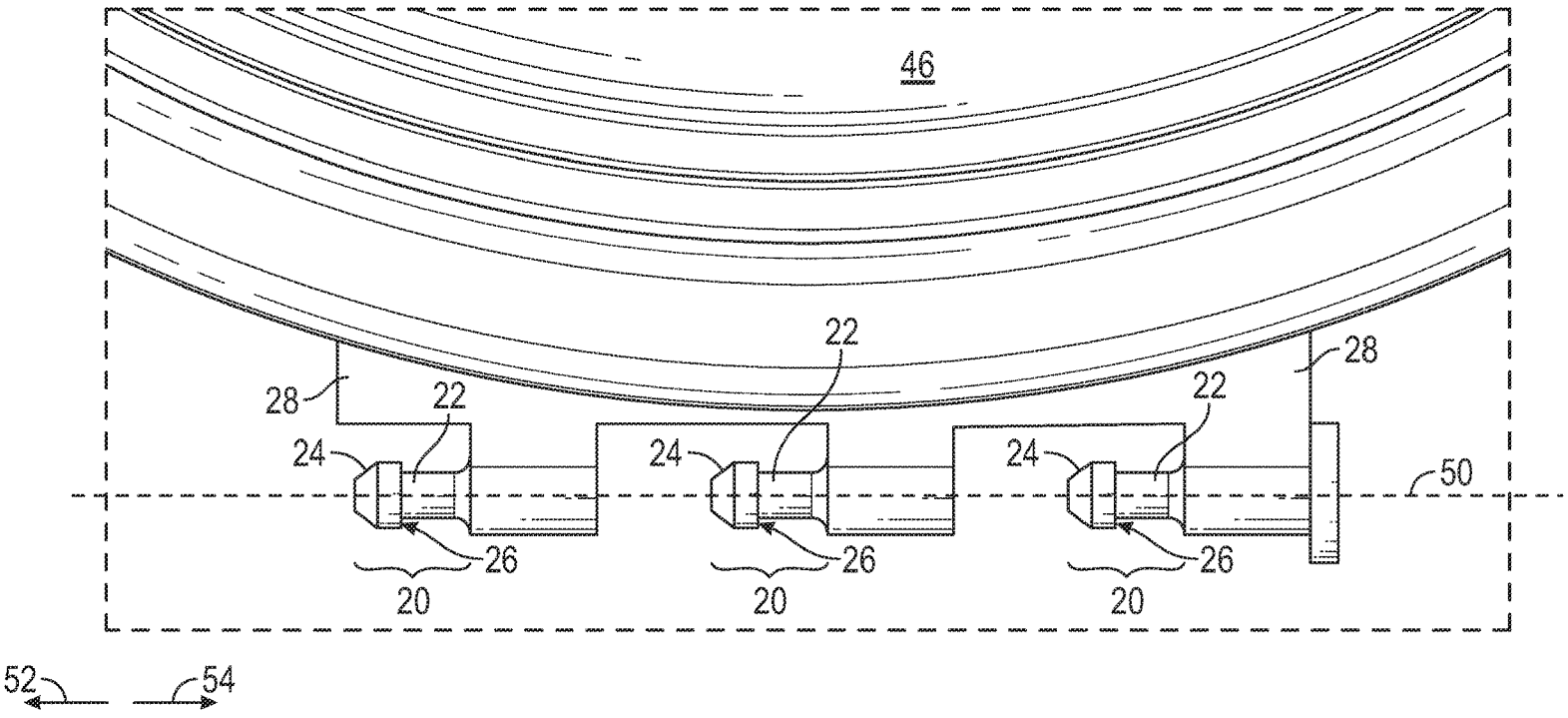
FIG. 10 shows a partial top plan view of a lid comprising a hinge leaf and hinge pins attached thereto in accordance with the present disclosure.

In a preferred embodiment, as shown in FIGS. 1-12, the hinge connecting the lid 46 to the receptacle 44 has interlocking pins 20 and knuckles 30 that are designed to rotatably lock together once the lid 46 is connected to the receptacle 44 so that the lid 46 cannot be easily disconnected from the receptacle 44 by disassembling the hinge. In this embodiment, the hinge comprises one or more mating pins 20 and one or more corresponding knuckles 30 that lock in an axially fixed position relative to each other when mated together. Each pin 20 is integrally attached to the lid 46, and each knuckle 30 is integrally attached to the receptacle 44. FIG. 10 illustrates a part of the hinge having three pins 20, and FIGS. 1 and 1A illustrate a part of the hinge having three spaced knuckles 30, wherein each respective knuckle 30 corresponds to one individual pin 20. To connect the lid 44 to the receptacle 46, each pin 20 is inserted into a corresponding knuckle 30. FIG. 3 illustrates the lid and receptacle prior to insertion of the pins 20 into the corresponding knuckles 30, and FIG. 4 illustrates the lid 46 rotatably connected to the receptacle 44 after complete insertion of each pin 20 into each corresponding knuckle 30. Each pin 20 is configured for one-way insertion such that the inserted pin 20 cannot be removed by withdrawing the pin 20. Thus, once each of the corresponding pins 20 and knuckles 30 are locked in place, as best seen in FIGS. 4 and 7, the lid 46 may not be removed from the receptacle 44 by withdrawing each of the pins 20 from each respective knuckle 30. When mated together, each pin 20 and each knuckle 30 may freely rotate back and forth relative to each other within a defined angle of rotation such that the lid 46 may be moved between an open position, as shown in FIG. 4, and a closed position, as shown in FIG. 5. Each pin 20 is attached to a first leaf 28, which is attached to the lid 46, and each knuckle 30 is attached to a second leaf 42, which is attached to the receptacle 44. Thus, the hinge does not utilize a separate pin that is not attached to one of the components of the container.

As best seen in FIGS. 1-12, the first leaf 28 is integrally attached to the lid 46, and the second leaf 42 is integrally attached to the receptacle 44, which may be sealed closed by rotating the lid 46 via the hinge connecting the lid 46 to the receptacle 44. As also shown in FIGS. 1-12, the pins 20 are integrally attached to the first leaf 28, and the knuckles 30 are integrally attached to the second leaf 42. Alternatively, the container may be designed such that the pins 20 are attached to the receptacle 44 and the knuckles 30 are attached to the lid 46.

In a preferred embodiment, as best seen in FIGS. 8-10, the hinge comprises a plurality of axially aligned pins 20 attached to the first leaf 28 and a plurality of spaced knuckles 30 attached to the second leaf 42, wherein each knuckle 30 corresponds to a respective pin 20. As shown in FIGS. 8-10, the hinge preferably comprises three axially aligned pins 20 and three corresponding knuckles 30. The pins 20 are aligned along a fixed axis of rotation 50, and the first leaf 28 extends outwardly from the pins 20 in a lateral direction. As best seen in FIG. 10, each pin 20 has a body 22 and a head 24 having a diameter greater than a diameter of the body 22. As shown in FIGS. 8 and 9, each knuckle 30 defines a passageway 32 axially aligned with and sized to receive the head 24 of one of the pins 20 therein. In addition, as best seen in FIGS. 6 and 8, each knuckle 30 has an edge 38 sized and positioned to contact a bottom surface 26 of the head 24 of one of the pins 20 after insertion of the pin 20 into the knuckle 30, as shown in FIG. 7. Once the pin 20 is inserted, direct contact between the bottom surface 26 of the head 24 of the pin 20 and the edge 38 prevents axial movement of the pin 20 in a direction 54 opposite a direction 52 of insertion.

As shown in FIG. 9, the passageway 32 defined by each knuckle 30 is preferably an open passageway 32. As used herein, an open passageway refers to a passageway that is open (i.e., not closed around a circumferential perimeter of the passageway) along an axial length of the passageway that is aligned with the axis of rotation 50 when the hinge components are fully installed such that the lid 46 is rotatably connected to the receptacle 44, as shown in FIG. 7. Thus, each knuckle 30 preferably has an open side along the length of the passageway 32. In an alternative embodiment, the passageway 32 may be closed along its length. The passageway 32 is also open at one end to allow insertion of a pin 20 into the passageway, though the passageway may optionally be open or blind at the opposite end. In a preferred embodiment, both ends of the passageway 32 are open.

In addition, as best seen in FIGS. 8 and 9, each individual knuckle 30 preferably comprises a first semicircular element 34 and a second semicircular element 36 adjacent to the first element. The two adjacent semicircular elements 34 and 36 define the passageway 32 along its axial length. As used herein, a "semicircular element" refers to a component of a hinge knuckle having an inner surface that defines a passageway that is at least partially open along an axial length of the passageway and is not limited to an element having a shape of a half of a circle. As seen in FIG. 7, the adjacent semicircular elements 34 and 36 are preferably positioned such that a small gap 48 exists between the elements. This gap 48 allows the receptacle 44, the knuckles 30, and the leaf 42 to all be formed from a unitary piece of material by an injection molding process, as discussed below.

As seen in FIGS. 8 and 9, each element 34 and 36 of each knuckle 30 preferably has an opening along the axial length of the passageway 32 defined by the elements 34 and 36, and the openings of the two elements 34 and 36 are preferably not aligned. For instance, the opening of the first knuckle element 34 faces in a lateral direction opposite the second leaf 42 to which the knuckles 30 are attached, and the opening of the second knuckle element 36 faces in an upward direction perpendicular to the second leaf 42 as shown in FIG. 9. Thus, the open sides along the axial length of the elements 34 and 36 are not aligned with each other.

In a preferred embodiment, as best shown in FIG. 9, each knuckle 30 preferably has a grooved notch 40 extending along a length of the knuckle 30 in an axial direction. As shown in FIG. 9, the notch 40 is preferably formed in one side of the first semicircular element 34. The notch 40 allows the element 34 of each knuckle 30 to slightly flex outwardly in a radial direction. The element 34 flexes to an extent that causes the size of the passageway 32 to expand sufficiently to allow the head 24 of the pin 20 to pass through the first element 34 of the knuckle 30 and into a segment of the passageway 32 defined by the second element 36. The first element 34 (into which the head 24 of the pin 20 is first inserted) of each knuckle 30 and the head 24 of each corresponding pin 20 are sized such that an exterior surface of the head 24 contacts an interior surface of the element 34 when the pin 20 is inserted into the passageway 32 defined by the knuckle 30. Force is applied to the pin 20 to forcibly insert the head 24 of the pin through the first element 34 of the knuckle 30. As seen in FIG. 10, the head 24 of each pin 20 preferably has a rounded or sloped exterior surface to facilitate insertion of the pin 20 by forcing the element 34 to flex outwardly when inserting the head 24 of the pin 20 through the segment of the passageway 32 defined by the first element 34.

As shown in FIG. 8, each knuckle 30 has an edge 38 preferably positioned between the first 34 and second elements 36 of the knuckle. The edge 38 may be formed by the first semicircular element 34 having a slightly smaller internal diameter than the adjacent second element 36. The head 24 of the pin 20 is inserted into the passageway 32 past the edge 38 so that the head 24 of the pin 20 generally rests within the second semicircular element 36, as shown in FIG. 7. The internal diameter of the second element 36 is slightly larger than an external diameter of the head 24 such that the head 24 may freely rotate within the element 36. As the head 24 of the pin 20 passes through the first element 34 of the knuckle 30, the element 34 flexes radially outward so that the size of the passageway 32 expands slightly to allow the head 24 to pass through. Once the head 24 of the pin 20 is inserted past the edge 38, the first element 34 returns to the original shape of the element before flexing. The edge 38 of the element 34 may then contact the bottom surface 26 of the head 24 of the pin 20, thereby preventing removal of the pin 20 by withdrawing the pin 20. The bottom surface 26 of the head 24 extends around the circumference of the head 24. FIG. 6 shows a cross section of the hinge with the head 24 of each pin 20 fully inserted and resting within the second element 36 of each knuckle 30. As seen in FIG. 6, the edge 38 may be formed by a circumference of the first semicircular element 34 such that the edge 38 may contact the bottom surface 26 of the head 24 around a portion of the circumference of the head 26 on opposing sides of the head 24, e.g., at both an upper side and a lower side of the head 24 of the pin 20 when the pin is positioned horizontally as shown in FIG. 6.

To connect the lid 46 to the receptacle 44, each of the pins 20 is positioned in axial alignment with each of the respective knuckles 30, as shown in FIG. 3. Each pin 20 is then simultaneous inserted into each respective knuckle 30, as shown in FIG. 4, until the head of each pin 20 moves past the edge 38 of the first element 34. The edge 38 then prevents axial movement of the pin 20 in a direction 54 opposite the direction 52 of insertion of the pin 20. In addition, the first leaf 28 is preferably shaped such that a laterally extending portion of the first leaf 28 that is directly attached to a pin 20 may prevent axial movement of the pin 20 in the direction 52 of insertion by contacting a corresponding first element 34 of the knuckle 30. In addition, the unaligned configuration of the side openings along an axial length of each of the first and second elements 34 and 36 prevents forcible removal of the pins 20 from the knuckles 30 in a lateral direction through the side openings.

The length of the body 22 of each pin 20 is preferably sized to be slightly longer than the axial length of the first element 34 so that each pin 20 may move back and forth a small distance within each knuckle 30 within an allowable tolerance in order to provide free rotation between the pins 20 and knuckles 30. Once fully inserted into a knuckle 30, each pin 20 is locked in an axially fixed position (excepting slight back and forth movement within a knuckle) relative to the knuckle 30, and the pin 20 and knuckle 30 may freely rotate back and forth relative to each other within a defined angle of rotation in order to allow movement of the lid 46 between and open and a closed position.

Figure 14:
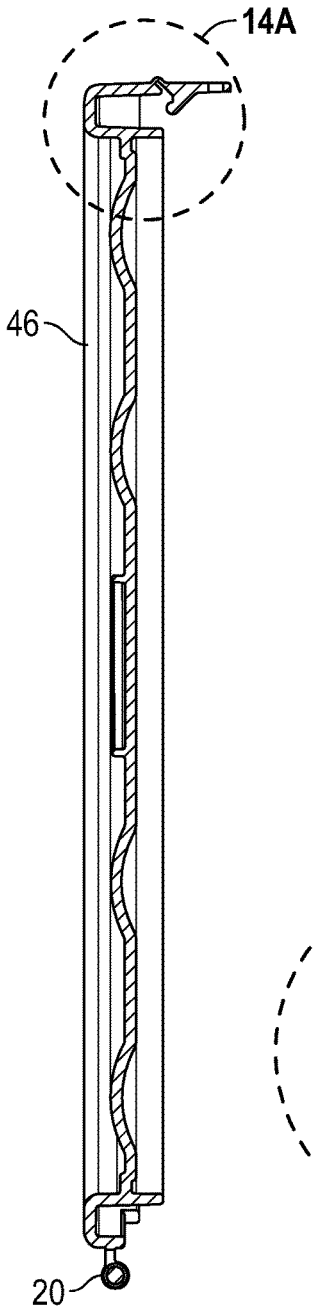
FIG. 14 shows a cross-sectional view of a lid comprising a latch and a hinge leaf with hinge pins attached thereto as seen along line 14-14 in FIG. 2.
Figure 14A:
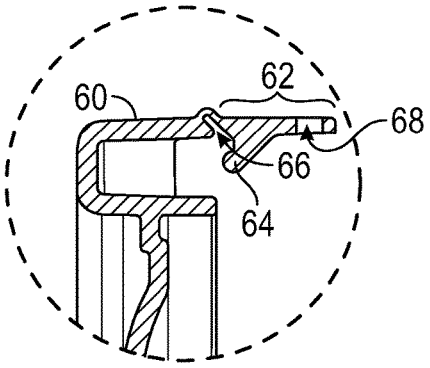
FIG. 14A shows a partial view of the lid as shown in FIG. 14.
Figure 15:
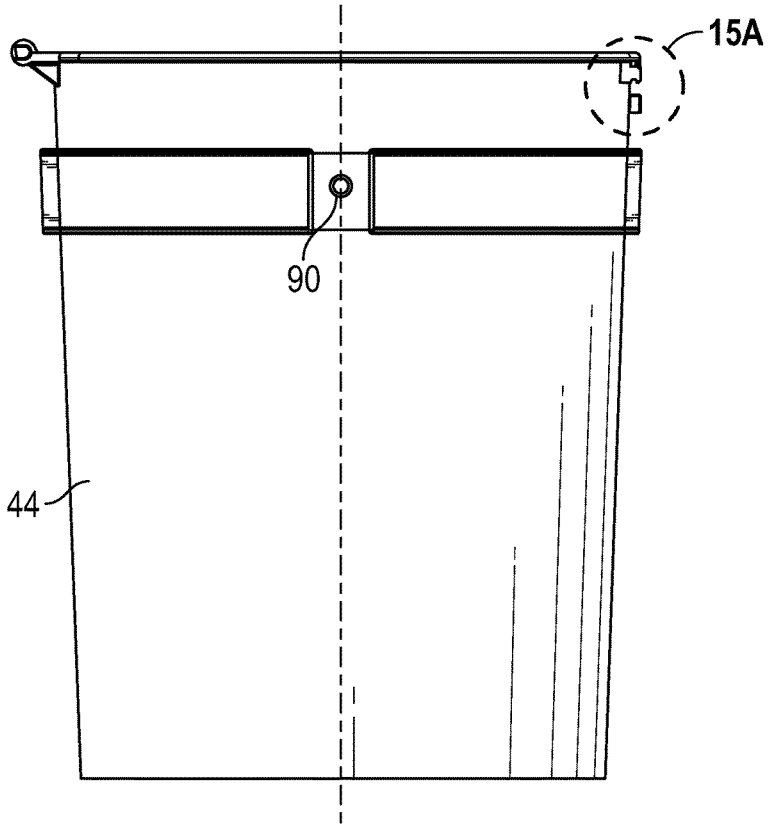
FIG. 15 shows a side elevational view of a receptacle in accordance with the present disclosure.
Figure 15A:
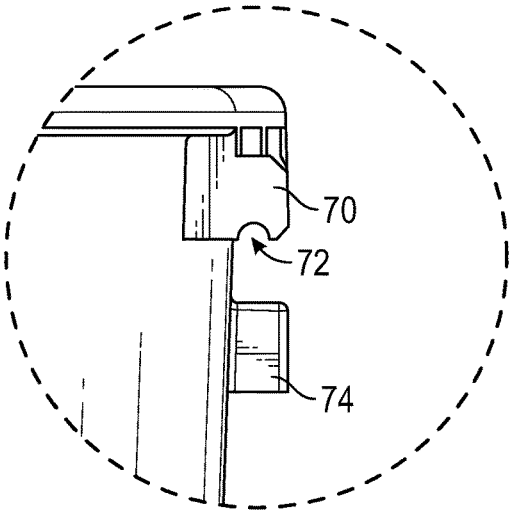
FIG. 15A shows a partial side elevational view of a receptacle in accordance with the present disclosure.
Figure 16:
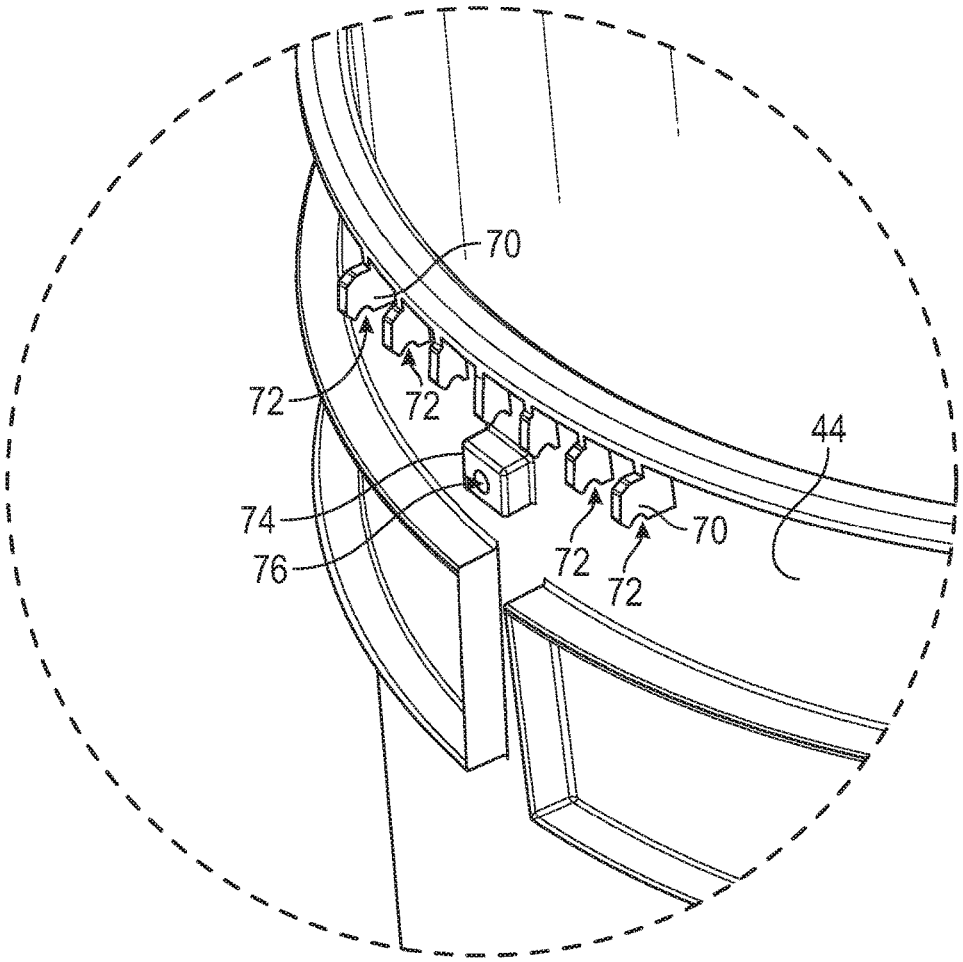
FIG. 16 shows a partial perspective view of a receptacle in accordance with the present disclosure.
Figure 17:
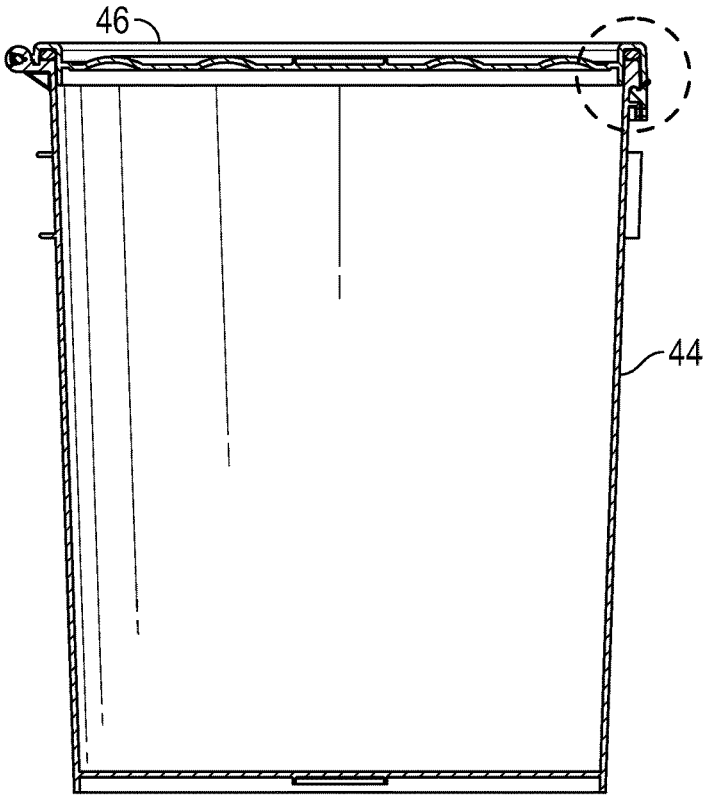
FIG. 17 shows a cross-sectional view of a receptacle and lid with the lid closed as seen along line 17-17 in FIG. 5.
Figure 17A:
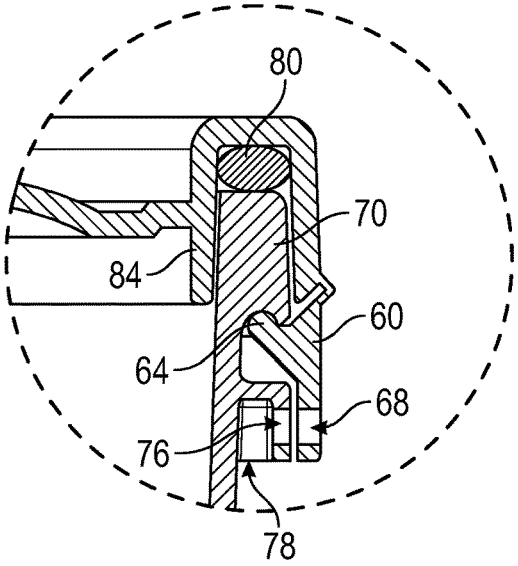
FIG. 17A shows a partial view of the receptacle with closed lid as shown in FIG. 17.

As best shown in FIGS. 11-14A, the lid 46 has a latch 60 configured to seal the receptacle 44 closed when the lid 44 is moved to the closed position and the latch 60 is secured to the receptacle 44, as shown in FIG. 17A. In a preferred embodiment, as best shown in FIG. 14A, the latch 60 has a lower portion 62 that is flexible to an extent sufficient to allow the latch 60 to be secured to and detached from the receptacle 44. The latch 60 has a groove 66 extending along a width of the latch 60 such that the lower portion 62 of the latch is attached to the remainder of the latch by a relatively thin piece of material, thereby allowing the lower portion 62 of the latch 60 to bend inward and outward for securing and detaching the latch 60. The latch has one or more protrusions 64 positioned along the width of the latch and configured to fit within a groove 72 formed within a series of securing elements 70 integrally attached to the receptacle 44, as shown in FIGS. 15A and 16. Alternatively, the groove 72 may be formed within a single securing element. The groove 72 is positioned on a bottom side of the securing elements 70, and the latch 60 may be secured to the receptacle 44 by inserting the protrusions 64 into the groove 72. To detach or unsecure the latch 60, the lower portion 62 may be bent outward to remove the protrusions 64 from the groove 72 in order allow the lid 46 to move from the closed position to the open position.

Figure 12:
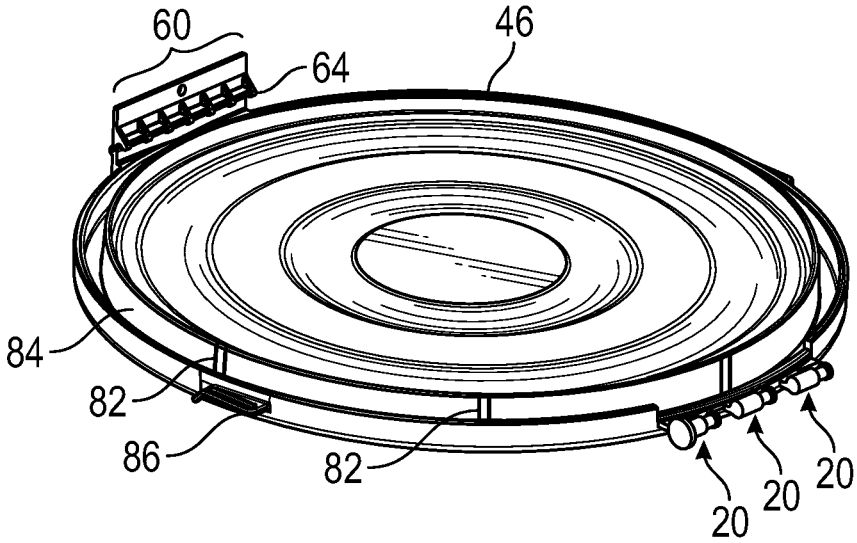
FIG. 12 shows a bottom perspective view of a lid comprising a latch and a hinge leaf with hinge pins attached thereto in accordance with the present disclosure.
Figure 13:
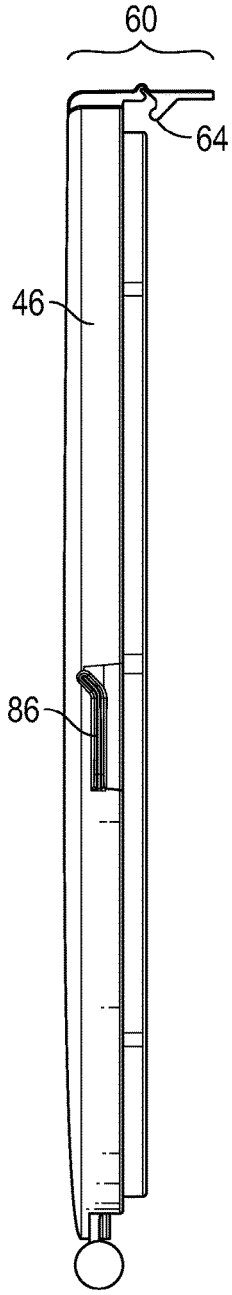
FIG. 13 shows a side elevational view of a lid comprising a latch and a hinge leaf with hinge pins attached thereto in accordance with the present disclosure.

FIGS. 17 and 17A illustrate cross section views of the receptacle 44 with the lid 46 in a closed position and the latch 60 secured to the receptacle 44 such that the receptacle 44 is sealed close. The lid 46 preferably has a seal 80 installed thereon in order to seal the receptacle 44 closed to prevent leakage of chemicals stored therein. The seal 80 may be any suitable seal or gasket made of rubber or similar material suitable for forming a seal between components. The seal 80 may be installed on the inside of the lid 46 after the container components have been manufactured. In addition, the inside of the lid 46 is designed to further prevent leakage. As shown in FIG. 12, the inside of the lid 46 has a wall 84 positioned around the inside of the lid such that the wall 84 is positioned directly adjacent to and in contact with an interior surface of the sidewall of the receptacle 44 when the lid 46 is in the closed position, as shown in FIG. 17A. The wall 84 in combination with the seal 80 and a lip extending around a circumference of the lid 46 provide a container having a sealed interior when the lid is closed. The wall 84 preferably has a plurality of small ridges 82 on an exterior side of the wall 84, as shown in FIG. 12, that help to hold the seal 80 in place after installation on the lid 46 when the lid is moved into the open position.

Figure 11:
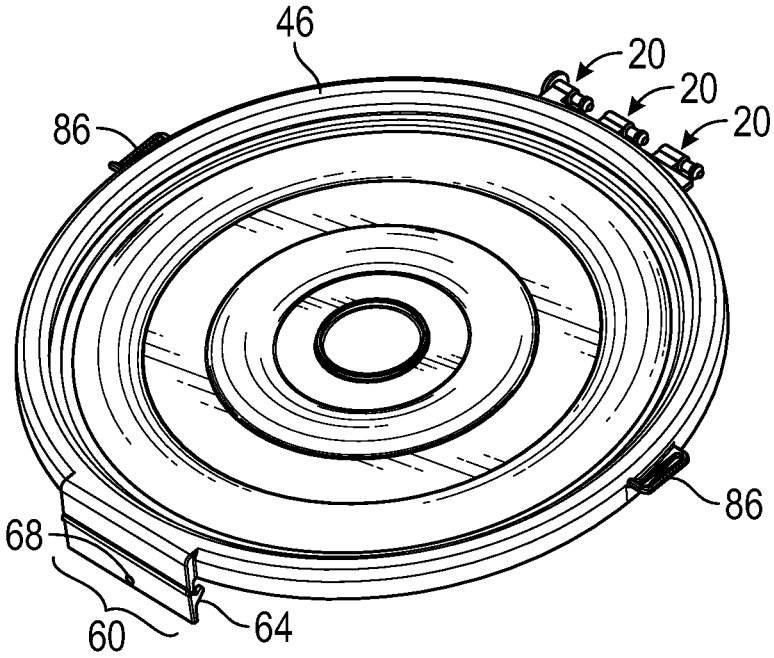
FIG. 11 shows a top perspective view of a lid comprising a latch and a hinge leaf with hinge pins attached thereto in accordance with the present disclosure.

In a preferred embodiment, as shown in FIGS. 11 and 14A, the lower portion 62 of the latch 60 has a hole 68 extending therethrough. In addition, the receptacle 44 preferably has a box 74 integrally attached thereto and having a hollow interior, as shown in FIG. 16. The box 74 has on outward facing hole 76 that provides access to the interior. The hole 76 is aligned with the hole 68 in the latch 60 when the latch is secured to the receptacle 44 as shown in FIG. 17A. In addition, the box 74 has an open side 78 on the bottom side of the box. The aligned holes 68 and 76 and the open side 78 allow a car seal to be installed on the container so as to prevent unauthorized opening of the container in order to comply with operating procedures and/or regulations such as Department of Transportation regulations.

In a preferred embodiment, the components of the container, including the receptacle 44 and the lid 46, as well as the leaves 28 and 42, the pins 20, the knuckles 30, the latch 60, and the securing elements 70, are made of a plastic material such as high-density polyethylene or a similar type of thermoplastic or thermosetting polymer. Alternatively, the components of the container may be constructed of any suitable metal or metal alloy. The material of construction is preferably a relatively hard and durable material that has a small amount of flexibility to allow the knuckles 30 to flex slightly when inserting the pins 20 but that returns to and retains its original shape after insertion of the pins 20, in addition to allowing the lower portion 62 of the latch 60 to bend inward and outward for securing and detaching the latch 60. In alternative embodiments, different components, such as the first element 34, may be made of different materials. Once the pins 20 are fully inserted, the pins 20 cannot be withdrawn by pulling the pins 20 in the opposite direction 54 of the direction 52 of insertion. In this embodiment, the hinge is designed such that the pins 20 become permanently locked in place once inserted into the knuckles 30. As such, although it may be possible to remove the pins 20 by prying open the first element 34 of the knuckle 30 using a tool, the construction material of the knuckles as well as the shape and dimensions of the element 34 prevent removal of the pins without causing damage to the hinge.

A method of manufacturing a container as described above is also provided. To manufacture the container, two separate parts are injection molded. The first part comprises the lid 46 including the latch 60 and the first leaf 28 and axially aligned pins 20 attached thereto. The second part comprises the receptacle 44 including the securing elements 70 and the second leaf 42 and spaced knuckles 30 attached thereto. Each of the two parts is formed entirely from a unitary piece of material through the process of injection molding. As used herein, injection molding includes the process of die-casting metal material. Depending on the particular application, certain chemical compositions to be stored may require particular types of plastics, metals, or metal alloys. In a preferred embodiment, each knuckle 30 defines a passageway 32 that is open and includes adjacent elements 34 and 36 having a gap 48 between them. The open sides of the elements 34 and 36 and the gap 48 between elements allow the receptacle 44, second leaf 42, and knuckles 30 to be injection molded as a unitary piece. Alternatively, the injection molded receptacle 44 may include solid knuckles (without a passageway), and a closed passageway may be formed by drilling a hole through each of the solid knuckles as a separate step subsequent to molding. In this embodiment, one or more axially extending grooves may be formed in the interior of each knuckle to allow each knuckle to radially expand outwardly so that the head of a pin may be inserted into the knuckle.

Utilizing injection molded, unitary pieces of material to form the two individual parts of the container allows the container to be manufactured in a simple, cost-effective manner. In addition, utilizing only two separate parts provides for simple connection of the lid 46 to the receptacle 44 and does not require the use of a separate pin in the hinge.

Figure 19:
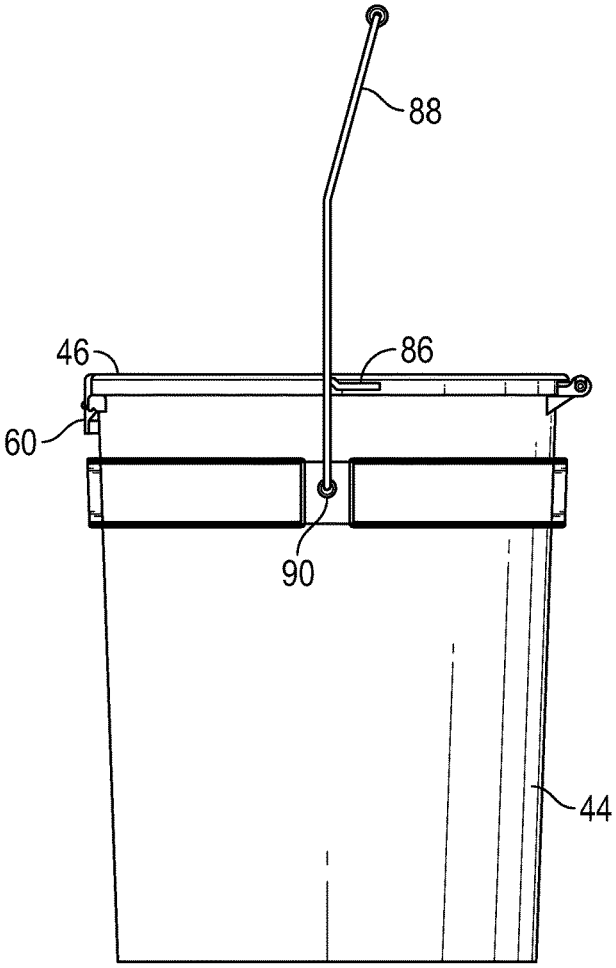
FIG. 19 shows a side elevational view of a receptacle with a closed lid and a handle secured to the receptacle in accordance with the present disclosure.
Figure 20:
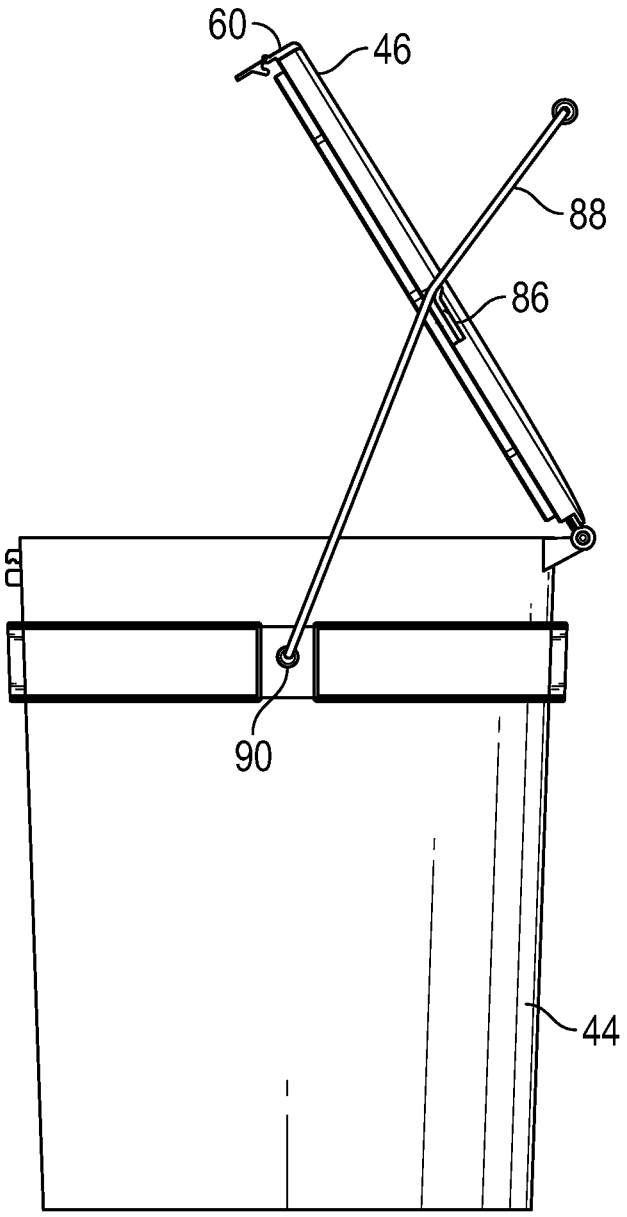
FIG. 20 shows an elevational view of a tilted receptacle with an open lid and a handle secured to the receptacle in accordance with the present disclosure.

In a preferred embodiment, as shown in FIG. 19, the container further comprises a handle 88 having two ends. Each end is rotatably secured to an opposing side of the receptacle 44 such that the handle 88 may be rotated as illustrated in FIGS. 19 and 20. Each end of the handle may be secured within a small hole 90 positioned on an exterior portion of the receptacle such that each end may rotate within the hole 90 (the hole 90 does not extend into the interior of the receptacle). In a preferred embodiment, as best seen in FIGS. 11, 13, 19, and 20, the lid 46 has two handle guides 86 attached to opposing sides of the lid. As shown in FIG. 11, the handle guides 86 extend outwardly from the lid 46. The handle guides 86 are positioned to move the lid 46 from a closed position, as shown in FIG. 19, to an open position, as shown in FIG. 20, when rotating the handle 88 from one side of the receptacle 44 toward an opposite side of the receptacle (in a clockwise direction from the perspective shown in FIGS. 19 and 20). The handle guides 86 are preferably angled upward at one end such that the angled end contacts the handle 88, as shown in FIG. 19, when rotating the handle to open the lid. In this embodiment, the handle 88 is preferably angled at a point along a length of the handle. The angled end of the guide 86 may contact the handle 88 as the guide 86 slides along the handle as the handle is rotated. As shown in FIG. 20, the angled end of the guide 86 may stop movement of the lid 46 toward an open position when the angled end of the guide 86 reaches the angle in the handle 88. The handle guides 86 allow a user to unsecure the latch 60 and then hold the handle 88 with one hand and the receptacle 44 with the other hand and pour contents out of the receptacle 44 by tilting the receptacle. When doing so, the lid 46 is held in place and does not drop downward, which could disrupt the flow of the contents from the receptacle 44.

Figure 18:
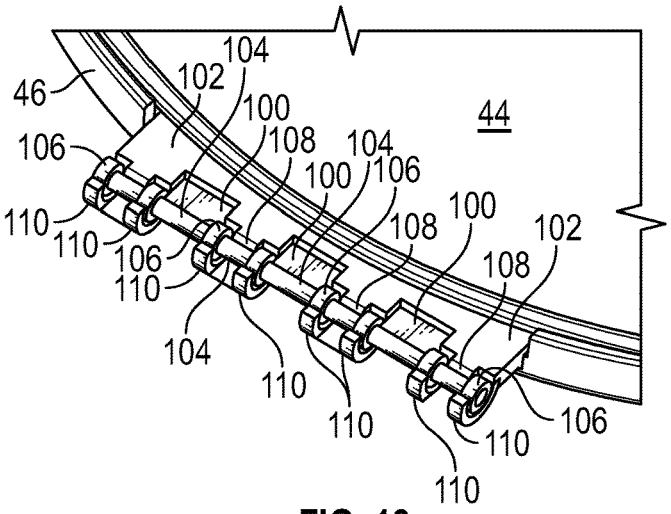
FIG. 18 shows a partial bottom perspective view of an alternative embodiment of a hinge connecting a lid to a receptacle in accordance with the present disclosure.

FIG. 18 illustrates an alternative embodiment of a hinge that may be used to rotatably connect the lid 46 to the receptacle 44. FIG. 18 shows a bottom perspective view such that the bottom side of the hinge is shown when the container is in an upright position. In this embodiment, the receptacle 44 and the lid 46 are also each formed from a single injection molded piece of material. The lid 46 comprises a first leaf 100 having a pin 104 attached thereto, and the receptacle 44 comprises a second leaf 102 having a plurality of spaced semicircular snap elements 110 attached thereto and a plurality of snap protrusions 108 disposed between adjacent snap elements 110. The pin 104 has a plurality of enlarged sections 106 spaced along a length of the pin 104 and having a diameter greater than a diameter of the pin 104. Each snap element 110 corresponds to one enlarged section 106 of the pin 104 such that the snap element 110 fits around the enlarged section 106. Each snap protrusion 108 is preferably sized to fit between two adjacent enlarged sections 106 of the pin 104. When the receptacle 44 is in an upright position, the semicircular snap elements 110 preferably each have an open side that faces downward. The snap elements 110, including the downward facing open sides, and the snap protrusions 108 are configured to removably secure the lid 46 to the receptacle 44 such that the lid may be rotated to open and closed positions. The semicircular snap elements 110 are sized and positioned such that the enlarged sections 106 of the pin 104 may be snapped into place, as shown in FIG. 18, by laterally inserting the enlarged sections 106 through the open sides of the snap elements 110. Once the pin 104 is laterally inserted, the snap protrusions 108 provide additional support to limit lateral movement of the pin 104 within the snap elements 110. In addition, the snap protrusions 108 fit between adjacent enlarged sections 106 of the pin in order to limit axial movement of the pin within the snap elements 110. The pin 104 is attached to the first leaf 100, though the first leaf 100 has open sections to fit around pairs of adjacent snap elements 110. Once laterally inserted, the pin 104 may freely rotate within the semicircular snap elements 110 to open and close the lid 46. To remove the lid 46 from receptacle 44, downward force may be applied to the pin 104 to dislodge the pin from the snap elements 110.

It is understood that versions of the present disclosure may come in different forms and embodiments. Additionally, it is understood that one of skill in the art would appreciate these various forms and embodiments as falling within the scope of the invention as disclosed herein.

What is claimed is:

1. A container comprising a receptacle and a lid rotatably connected to the receptacle via a hinge, wherein the hinge comprises a mating pin and knuckle, wherein the pin is configured for one-way insertion into the knuckle such that the pin is locked in an axially fixed position relative to the knuckle when mated with the knuckle, and wherein the pin and knuckle freely rotate back and forth relative to each other within a defined angle of rotation between an open lid position and a closed lid position when the pin is mated with the knuckle, wherein the lid has a latch configured to seal the receptacle closed when in the closed lid position, and wherein the container further comprises a handle having two ends each rotatably secured to an opposing side of the receptacle, wherein the lid has handle guides attached to opposing sides of the lid and extending outwardly from the lid, wherein the handle guides are positioned to move the lid from the closed lid position to the open lid position when rotating the handle from one side of the receptacle to an opposite side of the receptacle.

2. The container of claim 1, wherein the pin has a body and a head having a diameter greater than a diameter of the body, wherein the knuckle defines a passageway axially aligned with and sized to receive the head of the pin therein, wherein the knuckle has an edge sized and positioned to contact a bottom surface of the head of the pin after insertion of the pin into the knuckle, and wherein the edge prevents axial movement of the pin in a direction opposite a direction of insertion.

3. The container of claim 1, wherein the pin is attached to a first leaf that is attached to the lid, and the knuckle is attached to a second leaf that is attached to the receptacle.

4. The container of claim 3, wherein the lid, the first leaf, the pin, and the latch are formed from a unitary injection molded piece of material.

5. The container of claim 3, wherein the receptacle, the second leaf, and the knuckle are formed from a unitary injection molded piece of material.

6. A container comprising a receptacle and a lid rotatably connected to the receptacle via a hinge, wherein the lid has a latch configured to seal the receptacle closed when the lid is in a closed position, wherein the hinge comprises a plurality of axially aligned pins attached to a first leaf and a plurality of spaced knuckles attached to a second leaf, wherein each knuckle corresponds to a respective pin, wherein each pin has a body and a head having a diameter greater than a diameter of the body, wherein each knuckle defines a passageway axially aligned with and sized to receive the head of one of the plurality of pins therein, wherein each knuckle has an edge sized and positioned to contact a bottom surface of the head of one of the plurality of pins after insertion of the pin into the knuckle, and wherein the edge prevents axial movement of the pin in a direction opposite a direction of insertion, wherein the container further comprises a handle having two ends each rotatably secured to an opposing side of the receptacle, wherein the lid has handle guides attached to opposing sides of the lid and extending outwardly from the lid, wherein the handle guides are positioned to move the lid from the closed lid position to an open lid position when rotating the handle from one side of the receptacle to an opposite side of the receptacle.

7. The container of claim 6, wherein the lid, the first leaf, the plurality of axially aligned pins, and the latch are formed from a unitary injection molded piece of material.

8. The container of claim 6, wherein the receptacle, the second leaf, and the plurality of spaced knuckles are formed from a unitary injection molded piece of material.

9. The container of claim 6, wherein each knuckle defines an open passageway.

10. The container of claim 9, wherein each knuckle has a grooved notch extending along a length of the knuckle in an axial direction, wherein the notch allows the knuckle to flex to an extent sufficient to allow the head of one of the plurality of pins to pass therethrough.

11. The container of claim 9, wherein each knuckle comprises two adjacent semicircular elements having openings that are not aligned, wherein one of the elements has a grooved notch extending along a length of the element in an axial direction, wherein the notch allows the element to flex to an extent sufficient to allow the head of one of the plurality of pins to pass therethrough.

12. A method of manufacturing a container, said method comprising the steps of:

injection molding a first unitary piece of material comprising a lid having a first leaf attached thereto and a plurality of axially aligned pins attached the first leaf, wherein each pin has a body and a head having a diameter greater than a diameter of the body;

injection molding a second unitary piece of material comprising a receptacle having a second leaf attached thereto and a plurality of spaced knuckles attached to the second leaf, wherein each knuckle defines a passageway axially aligned with and sized to receive the head of one of the plurality of pins therein, wherein each knuckle has an edge sized and positioned to contact a bottom surface of the head of one of the plurality of pins after insertion of the pin into the knuckle, and wherein the edge prevents axial movement of the pin in a direction opposite a direction of insertion; and rotatably securing two ends of a handle to opposing sides of the receptacle, wherein the lid has handle guides attached to opposing sides of the lid and extending outwardly from the lid, wherein the handle guides are positioned to move the lid from a closed lid position to an open lid position when rotating the handle from one side of the receptacle to an opposite side of the receptacle.

13. The method of claim 12, wherein each knuckle defines an open passageway.

14. The method of claim 13, wherein each knuckle has a grooved notch extending along a length of the knuckle in an axial direction, wherein the notch allows the knuckle to flex to an extent sufficient to allow the head of one of the plurality of pins to pass therethrough.

15. The method of claim 13, wherein each knuckle comprises two adjacent semicircular elements having openings that are not aligned, wherein one of the elements has a grooved notch extending along a length of the element in an axial direction, wherein the notch allows the element to flex to an extent sufficient to allow the head of one of the plurality of pins to pass therethrough.

16. A container comprising:

a receptacle and a lid, wherein the receptacle and the lid are each formed from a single injection molded piece of material, wherein the lid comprises a first leaf having a pin attached thereto, wherein the pin has a plurality of enlarged sections spaced along a length of the pin and having a diameter greater than a diameter of the pin, wherein the receptacle comprises a second leaf having a plurality of spaced semicircular snap elements attached thereto and a plurality of snap protrusions disposed between adjacent snap elements, wherein each snap element corresponds to one enlarged section of the pin, and wherein the snap elements and the snap protrusions are configured to removably secure the lid to the receptacle, wherein the container further comprises a handle having two ends each rotatably secured to an opposing side of the receptacle, wherein the lid has handle guides attached to opposing sides of the lid and extending outwardly from the lid, wherein the handle guides are positioned to move the lid from a closed lid position to an open lid position when rotating the handle from one side of the receptacle to an opposite side of the receptacle.

* * * * *